United States Patent [19]

Shirey

[11] Patent Number: 4,679,375

[45] **Date of Patent: * Jul. 14, 1987**

[54] SUSPENSION CEILING GRID SYSTEM WITH NARROW-FACED GRID

[75] Inventor: Richard Shirey, Avon Lake, Ohio

[73] Assignee: Donn Incorporated, Westlake, Ohio

[ * ] Notice: The portion of the term of this patent subsequent to Sep. 11, 2001 has been disclaimed.

[21] Appl. No.: 535,382

[22] Filed: Sep. 23, 1983

[51] Int. Cl.[4] ..... E04B 5/52

[52] U.S. Cl. ..... 52/777; 52/475; 52/667; 52/778

[58] Field of Search ..... 52/484, 489, 665-667, 52/777, 778, 475

[56] References Cited

U.S. PATENT DOCUMENTS

| | | | |
|---|---|---|---|
| 3,189,138 | 6/1965 | Znamirowski | 52/484 X |
| 3,207,057 | 9/1965 | Brown et al. | 52/475 X |
| 3,304,684 | 2/1967 | Mock et al. | 52/484 X |
| 3,359,696 | 12/1967 | Swaita | 52/778 X |
| 3,397,500 | 8/1968 | Watson, Jr. | 52/777 |
| 4,021,986 | 5/1977 | McCall et al. | 52/475 |
| 4,027,454 | 6/1977 | Schuplin | 52/489 X |
| 4,408,428 | 10/1983 | Brooke et al. | 52/489 |
| 4,470,239 | 9/1984 | Sauer | 52/777 |

FOREIGN PATENT DOCUMENTS

| | | | |
|---|---|---|---|
| 400994 | 2/1970 | Australia | 52/484 |
| 492623 | 4/1978 | Australia | 52/484 |

*Primary Examiner*—William F. Pate, III
*Assistant Examiner*—R. Chilcot
*Attorney, Agent, or Firm*—Pearne, Gordon, McCoy & Granger

[57] ABSTRACT

A narrow-faced suspension ceiling grid system is disclosed which includes grid tees providing central webs and relatively narrow, oppositely extending flanges in combination with panel centering means. The narrow flanges provide improved aesthetics and reduce the material required to form the grid tees when compared to conventional wide-faced grid tees. The panel supporting flanges are sufficiently narrow that if the grid were used with conventional panels having a conventional amount of clearance, they would not reliably support the panels in the grid. However, when the centering means are provided to center the panels within the panel receiving openings, reliable support is provided for the panels.

22 Claims, 8 Drawing Figures

SUSPENSION CEILING GRID SYSTEM WITH NARROW-FACED GRID

BACKGROUND OF THE INVENTION

This invention relates generally to suspension ceiling grid systems, and more particularly to a novel and improved, narrow-faced grid for suspension ceilings which provides panel centering means to ensure that the panels are properly supported on the narrow panel supporting flanges of the grid.

PRIOR ART

Grid systems for suspension ceilings typically provide inverted T-shaped grid members which are formed with a central web, a bulb at the upper extremity of the web, and oppositely extending panel supporting flanges at the lower edges of the web.

The flange width of such grids are usually 15/16 inch to 1 inch in width. Such grid members or runners are interconnected to define rectangular panel openings bounded by the panel supporting flanges.

The center-to-center distance between runners on opposite sides of each opening determines the module size of the grid opening. For example, one common module size is 2'×4'. In such grids, the center-to-center spacing of the grid members extending along the long sides of the panel openings is 2 feet, and the center-to-center grid spacing of the grid members along the narrow side of the panel openings is 4 feet.

The standard panels for installation in such a grid are rectangular, and are undersized in both directions ¼ inch±1/16 inch. The panels are produced undersized or with clearance so that they can be easily positioned in or removed from the grid panel openings. Such a clearance ensures that the panels can be dropped down past the grid bulbs and the grid hanger wires and so that the panels will not bind on the webs of the grid.

When panels are provided with a clearance of ¼ inch ±1/16 inch, the minimum dimension of a panel for a 2'×4' module grid system is 1', 11 11/16 inches by 3', 11 11/16 inches. Since the standard grids have a flange width of at least 15/16 inch, the spacing between the web of a grid member from one side of a panel opening at the closest edge of the panel supporting flange on the opposite side of the opening (assuming a 2'×4' module) is 1', 11 17/32 inches by 3' 11 17/32 inches. (For purposes of this discussion, the webs are assumed to have zero thickness because they generally are formed of thin metal.) Since the panel size exceeds its corresponding dimensions by at least 5/32 inch, a non-centered panel (a panel positioned along one or two edges against the adjacent web) still extends over the opposed flange and is supported thereby by more than ⅛ inch. Because webs actually have some thickness, the overlap in the case of the non-centered panel is greater than 5/32 inch, and is usually at least about 3/16 inch, even when the panels are at minimum dimensions of their tolerances and are offset from the center the maximum possible amount.

FIG. 8 illustrates a typical prior art grid system in which the grid members provide a face or flange width of 15/16 inch and a standard lay-in panel with 5/16 inch clearance is positioned in a maximum off-center position but is still properly supported.

Because of this clearance requirement, conventional grid systems must be provided with a grid face width of at least about 15/16 inch, even though it is desirable in some instances, from a aesthetic standpoint and from a material standpoint, to provide narrower faced grids.

One prior art type of narrow faced grid is known. Such grid has a shape or cross section substantially as illustrated in U.S. Pat. No. 4,021,986. Such grids have been produced with a face width of about 9/16 inch, and are used with panels which are rabbeted along their lower edges to fit down along the sides of the lower box sections. Such panels, when installed, provide lower faces which are flush with the lower edges of the box section, as illustrated in FIG. 2 of such patent.

The engagement between the vertical sides of the rabbets and the sidewalls of the box section operates to center the panels within the openings, and thereby assure adequate panel support along all sides thereof, even though the panel supporting flanges at the upper edges of the box section are relatively narrow.

Such grid sections, however, require additional bends, and do not reduce the amount of metal required to produce the grids. Further, the rabbeted panels are more expensive to produce and must be produced to close tolerances.

Another type of narrow-faced grid is disclosed in the copending application (assigned to the assignee of the present invention) of Gale E. Sauer, Ser. No. 214,250, filed Dec. 8, 1980. In such grid system, a grid runner is provided with two diverging webs which space the grid flanges from each other and are sized to be resiliently compressed when the panels are installed. Reference to such application should be made for a more complete description of the structure of the grid system disclosed and claimed therein and such application is incorporated herein by reference.

SUMMARY OF THE INVENTION

The present invention provides a novel and improved, narrow-faced grid system which can be used with conventional lay-in panels, and does not require the use of rabbeted panels. Such grids provide substantially conventional T-shaped grid members which provide a central web, a bulb along one web extremity, and opposed panel supporting flanges along the opposite web extremity. Such flanges, however, are narrower than conventional grids.

The flanges are preferably at least about 9/16 inch wide when used with standard clearance panels, and are therefore incapable of reliably providing full support of non-centered panels. However, centering means are combined with the grid members which operate to center the panels and ensure proper panel support, even though the flanges are relatively narrow.

In one embodiment, the grid web is formed with laterally extending tabs which are shaped and sized to cam the panels to a center position and to maintain them in such position.

In a second embodiment, spring clips are located at intervals along the grid, which resiliently maintain the panels in their centered position.

In each embodiment, a simple, low-cost suspension ceiling grid system is provided in which the grid members are formed with aesthetically desirable, narrow-face. Because the grid face is narrow compared to conventional wide-faced grids, narrower material may be used to produce the grid members than is required to produce conventional wide-faced grid. Further, such grid members may be used with standard unrabbeted lay-in panels or tile.

These and other aspects of this invention are illustrated in the accompanying drawings, and are more fully described in the following specification.

DETAILED DESCRIPTION OF THE DRAWINGS

FIGS. 1 through 4 illustrate a first embodiment of this invention, in which grid members are provided with integral centering means at spaced locations along the webs of the tees.

Figure 1:
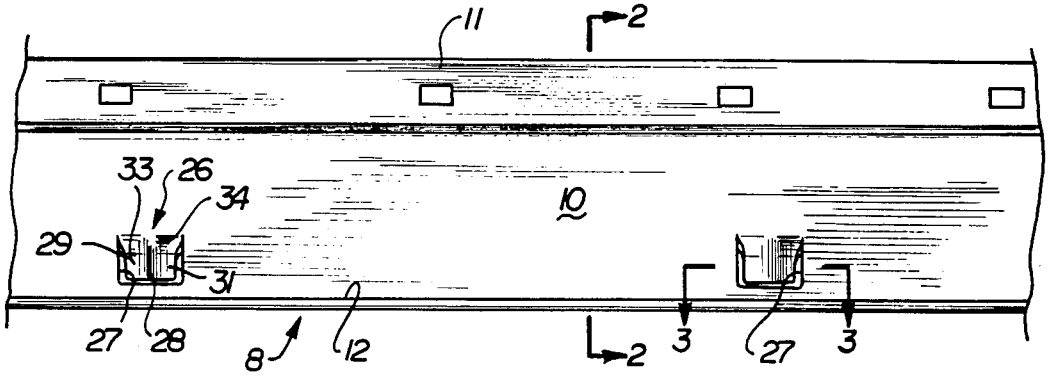
FIG. 1 is a side elevation of a grid member in accordance with the first embodiment of this invention.
Figure 2:
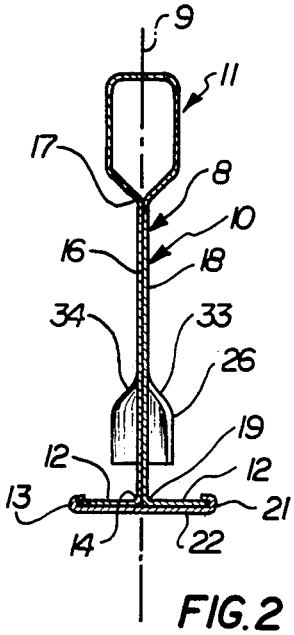
FIG. 2 is a cross section, taken along line 2—2 of FIG. 1, illustrating the grid cross section.
Figure 3:
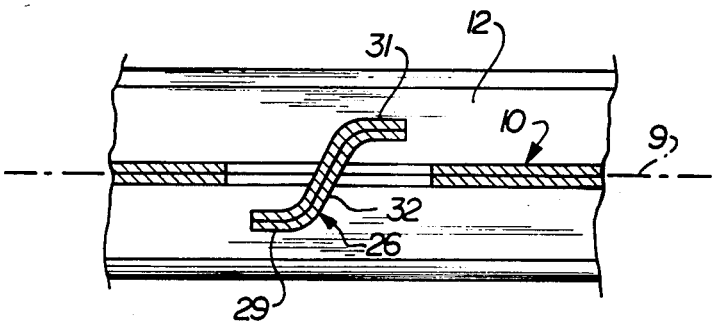
FIG. 3 is an enlarged longitudinal cross section through the centering tabs taken along line 3—3 of FIG. 1.

FIG. 3 illustrates the cross-sectional shape of the tee. Such tee 8 is symmetrical about a central plane 9 and includes a central web 10 providing a bulb 11 at the upper extremity of the web and opposed, laterally extending flanges 12 at the lower extremity of the web. In this embodiment, the tee is formed of a strip of material which extends inwardly from one edge at 13 to a first right angle bend at 14. From the right angle bend at 14, the strip extends up providing one layer 16 of the web at 10. At the upper extremity of the web layer 16, the strip is bent outwardly at 17 and above the web is formed in a closed box shape to provide the bulb 11. The strip then extends down the second web layer 18 to a right angle bend at 19 and out along the flange 12 to an edge 21.

A cap strip 22 is folded over the two outer edges 13 and 21 to form the face portion of the flanges.

The tee section thus far described is conventional in that it provides a bulb at one extremity of the web, a double-faced web and oppositely extending flanges at the lower extremity of the web. However, in this embodiment, the flanges 12 are much narrower than provided in a conventional grid tee and have a total face width of about 9/16 inch. As discussed above, conventional grid tees usually have a face width or flange width of 15/16 inch or 1 inch.

Formed at intervals along the length of the web are a plurality of centering tabs 26. These tabs in this illustrated embodiment are formed by making a U-shaped cut 27 through the two layers 16 and 18 of the web 10. Such cut produces a downwardly extending tab 28 which is twisted, as best illustrated in FIG. 3, to provide a first portion 29 substantially parallel to the plane 9 of the grid tee 8 and laterally spaced therefrom on one side of the web and a second portion 31 substantially parallel to the plane 9 but laterally spaced therefrom on the opposite side thereof. Intermediate the two portions 29 and 31, the tab provides an inclined or laterally extending portion 32 which joins the two portions 29 and 31. The two portions 29 and 31 are essentially planar, and in the illustrated embodiment are displaced on opposite sides of the central plane of the web 10 so that the outer surfaces of the portions 29 and 31 are spaced apart almost a quarter of an inch, with the result that such surfaces are located at slightly less than $\frac{1}{8}$ inch on each side of the central plane 9 of the web 10.

Above the planar portions 29 and 31, the tab provides two camming portions or transition portions 33 and 34, which are inclined inwardly from the planar portions 29 and 31, respectively, into the web itself. The planar portions 29 and 31 are spaced upwardly from the flanges 12 a short distance, and are sufficiently close to the flanges so that when a conventional tile or panel is placed in the grid opening, the planar portions engage the edges of the panel and space the edges thereof from the plane 9 of the web by a distance about $\frac{1}{8}$ inch. In practice, the centering tabs 26 are formed in the web at intervals along the length of each of the grid tee members, e.g., at intervals of about 3 inches.

Figure 4:
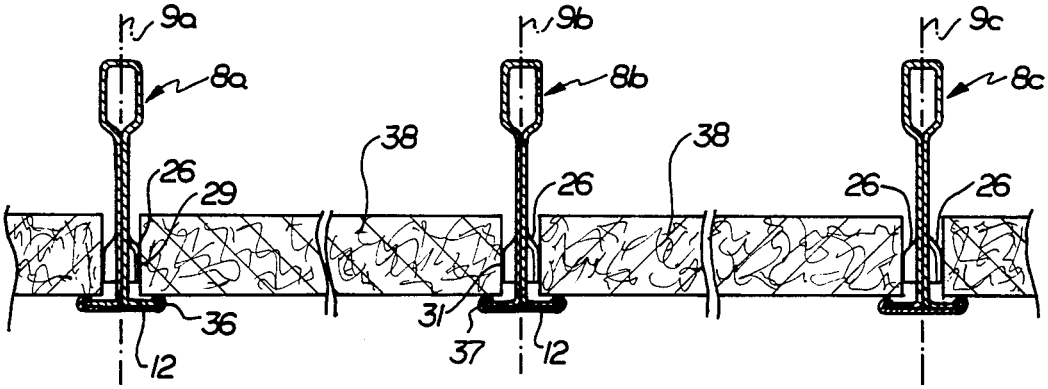
FIG. 4 is a fragmentary broken view of a portion of a ceiling incorporating grid members in accordance with the first embodiment of this invention.

Referring now to FIG. 4 when grid tees are assembled in a grid to define panel openings, a pair of grid tees 8 are located on opposite sides of each opening and the spacing between the central planes 9 is determined by the module size. One typical module size is 2'×4'. However, other module sizes are commonly provided. The panel openings are defined by opposed pairs of grid tees 8, with the first pair defining the 2-foot module dimension and perpendicularly extending second pairs defining the 4-foot module dimension. As illustrated in FIG. 4, one of the module dimensions is defined by a pair of parallel and laterally spaced grid tees **8*a* and 8*b* and an adjacent opening defined by grid tees 8*b* and 8*c*. The central planes 9*a* are spaced apart, for example, by 2 feet or 4 feet, depending upon which pair of grid members are being considered. For purposes of discussion, it is assumed that the grid members 8*a* and 8*b* define the 4-foot dimension of the module. Therefore, the central planes 9*a*** of these two grid members are spaced apart 4 feet.

Because the grid faces have a lateral width of 9/16 inch, the adjacent edges 36 and 37, respectively, of the grid members **8*a* and 8*b* are spaced apart by a distance of 4 feet minus 9/16 inch, or 3 feet, 11 7/16 inches. However, the spacing between the planar portion 29 of the centering tab on the grid 8*a* and the planar portion 31 on the centering tab of the grid member 8*b*** is slightly more than 3 feet, 11 $\frac{3}{4}$ inches.

As discussed above, a standard panel is provided with a clearance of $\frac{1}{4}$ inch ±1/16 inch, so a minimum corresponding dimension of a conventional 2×4 panel is 3 feet, 11 11/16 inches by 1 foot, 11 11/16 inches, and a maximum panel size within the tolerance range would be 3 feet, 11 13/16 inches by 1 foot, 11 13/16 inch. Even a minimum size panel, therefore, provides a lateral width along the 4-foot nominal dimension, which is greater than the lateral spacing between the adjacent edges of the adjacent flanges of 3 feet. 11 7/16 inch by about $\frac{1}{4}$ inch. Therefore, when a panel 38 is dropped into the opening and is centered by the centering tabs, it is supported or overlays the associated flange by about $\frac{1}{8}$ inch along each side edge of the panel. If the panel having a maximum dimension of 3 feet, 11 13/16 inches is inserted in the opening, it provides slightly more overlap or support by the flanges.

The centering tabs are sufficiently resilient to be deflected a small amount when a maximum diameter panel is installed to prevent binding or, in some instances in which the panels themselves are formed of relatively soft material, the centering tabs may provide a slight indentation of the concealed edges of the panels. In any event, a grid formed of grid members incorporating the first embodiment are provided with relatively narrow faces in the order of 9/16 inch wide, and proper support of standard panels is achieved because of the centering mechanism provided at intervals along the length of the flanges. In this embodiment, the face width of the grid tees is about 9/16 inch, which is less than twice the maximum panel clearance, and yet reliable panel support is provided.

Material savings are achieved when compared to conventional prior art grids because the flanges are substantially narrower, reducing the width requirement for the strip of material forming the main part of the tee and also for the facing cap. Since the centering tabs are formed from the material of the web, no additional material is required to provide the centering function, which ensures proper support of the panels.

Because each of the planar portions of the centering tabs 29 and 31 is joined to the adjacent portions of the web immediately thereabove by an inclined camming surface 33 or 34, the panels do not hang up and are automatically centered as they drop into position in the grid openings.

Figure 5:
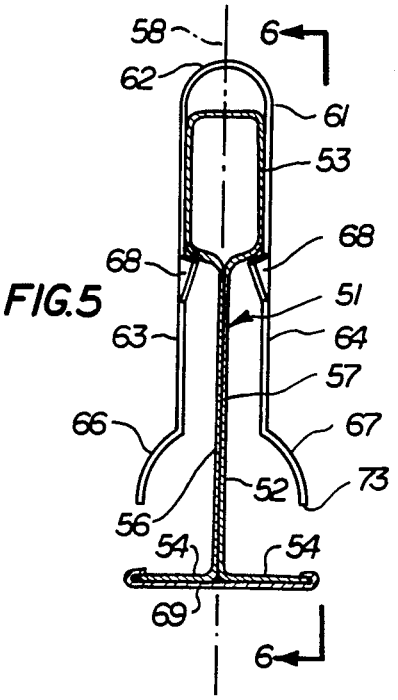
FIG. 5 is a cross-sectional view of a second embodiment of this invention, in which the spring clips are located at intervals along the length of the grid to center panels.
Figure 6:
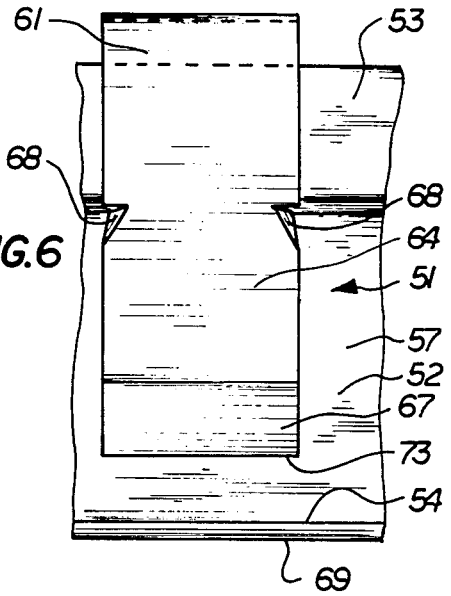
FIG. 6 is a fragmentary side elevation of the embodiment of FIG. 5.
Figure 7:
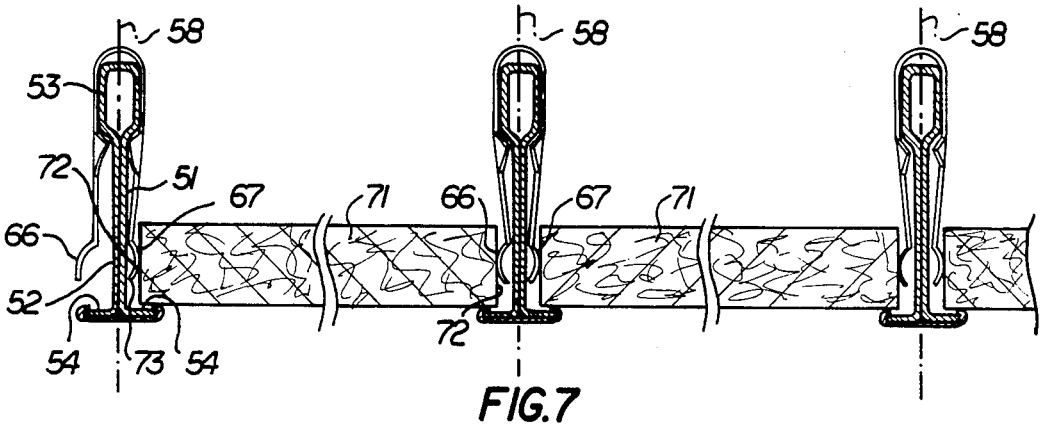
FIG. 7 is a fragmentray broken view of an installed ceiling, similar to FIG. 4 but illustrating such ceiling with grid members in accordance with the second embodiment of FIGS. 5 and 6.
Figure 8:
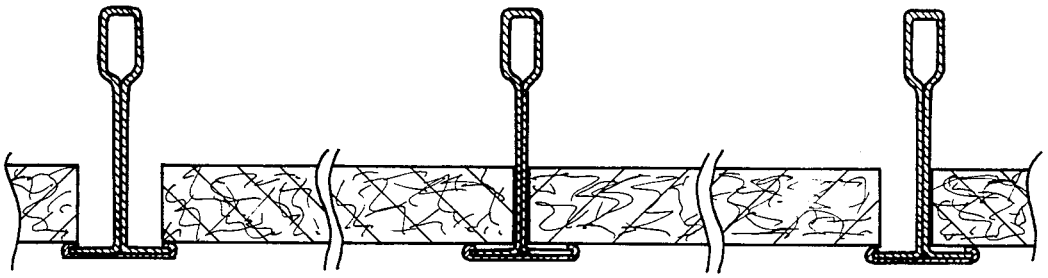
FIG.8 (PRIOR ART)
FIG. 8 is a fragmentary cross section of a typical prior art wide-faced grid illustrating how even off-center panels are supported.

FIGS. 5 through 7 illustrate another embodiment of this invention which provides a narrow-faced grid member in combination with centering means which ensure proper panel support with conventional lay-in panels. Here again, the grid member 51 provides a central web 52 formed with a closed, generally rectangular bulb 53 at its upper extremity and a pair of laterally extending flanges 54 at its lower extremity. The web 52 provides two layers 56 and 57, and the grid is symmetrical with respect to the central plane 58. A cap strip 69 extends along the lower faces of the flanges 54 and is bent around the outer edges thereof. In this illustrated embodiment, the cross section of the grid is identical with the cross section of the grid of the first embodiment. However, other cross sections may be utilized.

A spring clip 61 is mounted on the grid 51 at intervals along the length of the grid. Such spring clip is preferably formed of a thin, relatively resilient metal, and provides a U-shaped bend 62 at its upper end. Extending downwardly from the bend 62 are laterally spaced leg portions 63 and 64 which engage opposite sides of the bulb 53 and continue down along the opposite sides of the web 52. At the lower ends of the legs 63 and 64, the clip is provided with arcuate, outwardly extending end portions 66 and 67, respectively. In order to ensure that the clips remain on the grid, the legs are provided with inturned tabs 68 which extend in under the underside of the bulb 53 to prevent vertical upward movement of the clip with respect to the grid. These tabs, however, are shaped to blend into the legs as they extend downwardly so that the clip may be easily installed on the grid by simply pressing the clip down over the bulb. As the tabs pass the bulb, they cam the legs apart until the clip is properly installed and the tabs snap in underneath the bulb to lock the clip on the grid tee.

Here again, the grid tees are formed with a flange or face width of about 9/16 inch when intended for use with conventional panels. In its unstressed condition, the lower extremities of the portions 66 and 67 are substantially in vertical alignment with the adjacent edges of the flange. However, when a panel is installed, the legs are deflected inwardly from their unstressed condition by the engagement with the edges of the panels, as best illustrated in FIG. 7, and cooperate with the clips on the next adjacent parallel grid tee to automatically center the panels with respect to the panel openings.

As a panel 71 is dropped down into the panel openings defined by the assembled grid members, the edges 72 thereof engage the arcuate end portions 66 and 67, causing the legs to be deflected from their unstressed conditions inwardly. Because these portions are arcuate, a smooth camming action is provided. Once the panel reaches the flanges, as illustrated in FIG. 7, the legs are deflected from their unstressed condition and the legs engaging the opposite edges 72 of the panel automatically operate to center the panel with respect to the grid, so that the edges are spaced from the central planes 58 of the grids an equal amount around the entire panel opening. It is preferable to form the arcuate end portions 66 and 67 so that their lower edges 73 are spaced from the edges 72 of the panels when the panels are installed so that they do not dig into the panels if and when it becomes necessary to remove the panels from the grid.

Here again, when the grids are provided with a face width of about 9/16 inch and the panels are undersized with respect to the module size of the grid $\frac{1}{4}$ inch $\pm 16$ inch, a centered panel is supported by at least about $\frac{1}{8}$ inch overlap around the entire periphery of the panel. This condition exists even though the flanges have insufficient width to properly support a non-centered panel.

In this embodiment, the use of a separate centering clip simplifies the manufacture of the grid members. In fact, other than the provision of a narrower flange width or face width than is conventional, the only change in the grid member from conventional prior art grid members is the provision of a narrow face width. Therefore, production costs of the grid members are not increased and, since the grid face is narrower than conventional grids, material savings are achieved in the manufacture of the grid. Since the clips need only be provided at intervals along the length of the grid, they do not materially increase the material costs or manufacturing costs of the assembled grids.

It should be understood that even though the present invention has been illustrated in connection with a typical double-web grid member, it is equally applicable to grids with a single layer of web. Further, it is applicable to grid tees formed in other ways.

Although the preferred embodiments of this invention have been shown and described, it should be understood that various modifications and rearrangements of the parts may be resorted to without departing from the scope of the invention as disclosed and claimed herein.

What is claimed is:

1. A narrow-faced suspension ceiling grid system comprising a plurality of grid tees interconnected to form a grid providing a plurality of panel openings, said grid tees providing a bulb a planar central web and a pair of opposed flanges extending from the side of said web opposite said bulb, the lower surface of said flanges being exposed and providing said grid tees with a face having a fixed face width equal to the distance between the edge extremities of said opposed flanges, said edge extremities being spaced apart about 9/16 inch, a plurality of unrabbeted panels positioned in said panel openings each providing a lower planar surface extending to lateral edges thereof, said lower surface of said panels overlying associated flanges of said grid tees and being supported thereby, said panels being undersized with respect to said grid to provide a predetermined maximum clearance of about 5/16 inch with respect to said webs of said grid tees, said web providing centering means operable to center said panels and provide a substantially uniform spacing of at least about ⅛ inch between said edges of said panels and the plane of said webs.

2. A narrow-faced suspension ceiling grid as set forth in claim 1, wherein said centering means are provided by lateral projections formed in said web from the material of said web.

3. A narrow-faced suspension ceiling grid as set forth in claim 2, wherein said centering means are lanced projections cut from said web at spaced intervals along the length thereof, said lanced projections providing inclined camming surfaces extending from said web automatically operating to engage the edges of said panels and cam said panels into a centered position as said panels move into engagement with said flanges, said lance projections being twisted so that a single projection provides a camming surface on each side of said web.

4. A narrow-faced suspension ceiling grid as set forth in claim 3, wherein said lanced projections provide planar portions on each side of said web substantially parallel thereto.

5. A narrow-faced suspension ceiling grid as set forth in claim 4, wherein said lanced projections are laterally resilient.

6. A narrow-faced grid suspension ceiling comprising a panel supporting grid including a plurality of interconnected grid runners cooperating to define panel openings, said runners providing vertically extending webs and lateral flanges extending from and supported thereby, said openings being bounded by opposed pairs of said flanges, at least one pair of said flanges being spaced at first predetermined distance apart, panels positioned in said openings providing a lower surface overlying and supported by associated pairs of flanges along opposed edges of said panels, the one of said opposed pairs of edges associated with said one of said pairs of flanges being spaced from each other by a second predetermined distance greater than said first predetermined distance and at least substantially as small as the spacing between one flange of said one pair of opposed flanges and the web associated with the other flange of said one pair of flanges whereby a panel positioned against said web associated with said other flange of said one pair of flanges is inadequately supported by said one flange of said one pair of flanges, and centering means operating to center said panel in a location spaced from the edges of said flanges and from said webs so that both of said one pair of flanges adequately support the associated edges of said panel, said centering means including downwardly extending U-shaped lanced tabs formed from the material of said webs projecting laterally therefrom at longitudinal locations along the length of said grid runners, said tabs being twisted to provide portions on both sides of said webs whereby each tab is operable to provide centering of two panels wherein one panel of each two panels is located on each side of said web.

7. A narrow-faced suspension ceiling grid as set forth in claim 6, wherein said tabs are twisted to provide portions on both sides of said webs.

8. Narrow-faced grid tees for suspension ceiling grid systems comprising a central planar web, a bulb along one edge of said web, and oppositely extending fixed panel supporting flanges along the opposite edge of said web, said flanges providing opposite edge extremities spaced apart by about 9/16 inch, said tees being structured to be assembled in a grid defining panel openings bounded by exposed flanges of a predetermined size to support unrabbeted lay-in panels sized to provide a predetermined clearance of about ¼ inch with respect to the planes of said webs, said flanges having a width at least substantially as small as said clearance whereby uncentered panels would be inadequately supported by said flanges, said grid tees providing laterally positioned web portions operating as centering means operable to center panels in said openings causing reliable support thereof by said flanges, said centering portions being spaced about ⅛ inch from the plane of said web.

9. Narrow-faced grid tees as set forth in claim 8, wherein said centering means includes projections formed in said webs at longitudinally spaced locations along the length thereof.

10. A narrow-faced suspension ceiling grid system comprising a plurality of grid tees interconnected to form a grid providing a plurality of rectangular panel openings, said grid tees being substantially symmetrical with respect to a central plane thereof, said central planes of said grid tees on opposite sides of said panel openings being spaced by predetermined module spacings, said grid tees providing a central web and a pair of opposed flanges extending from the lower extremity of said web, the lower surface of said flanges providing said grid tees with an exposed face having a fixed face width equal to the distance between the edge extremities of said opposed flanges, said face width being substantially equal to 9/16 inch, a plurality of unrabbeted panels positioned in said panel openings each providing a lower planar surface extending to lateral edges thereof, said lower surface of said panels overlying associated flanges of said grid tees and being supported thereby, said panels being undersized with respect to the associated module sizes by substantially ¼ inch to provide clearance for installation of said panels in said panel openings, first portions of said web extending from the upper extremity thereof a substantial distance along their central planes, said webs providing centering portions substantially adjacent to said flanges which are laterally spaced on both sides of said central plane by a distance substantially equal to ⅛ inch, said centering portions engaging side edges of associated panels and centering said panels in said panel openings to ensure that the edges of said lower planar surfaces of said panels overlay the associated flanges by at least about ⅛ inch.

11. A narrow-faced suspension ceiling system as set forth in claim 10, wherein said webs are formed with spaced downwardly extending lanced projections which are twisted out of the plane of said web so that each lanced projection provides a portion on each side of the plane of said web providing centering means to center two panels when one panel is located on each side of said web.

12. An elongated grid runner for suspension ceiling grid systems comprising a bulb along one edge of said runner, a central web extending from one side of said bulb along a central plane and a pair of opposed laterally extending panel supporting flanges extending from the edge of said web opposite said bulb, said flanges extending to edge extremities spaced apart by substantially 9/16 inch, said web providing portions spaced from said central plane by about $\frac{1}{8}$ inch, said portions being operable to center unrabbeted panels in an assembled grid of said runners.

13. A grid runner as set forth in claim 12, wherein said portions spaced from said central plane are provided by lanced portions of said web bent to project laterally from the plane of said web and spaced at intervals along the length of said runners.

14. Panel centering grid tees for suspension ceilings in which the grid tees are interconnected to form a grid defining panel receiving openings in which lay-in panels are supported, comprising an elongated strip of sheet metal bent to provide a central substantially planar web extending along the central plane, a stiffening bulb along one side of said web, and a pair of flanges along the opposite side of said web extending in opposite direction from said web and substantially perpendicular to said central plane, said flanges providing said grid tees with an exposed face having a fixed face width, said grid tees providing connectors for interconnecting said grid tees in a grid defining rectangular panel openings bounded by said flanges so that lay-in panels can be supported in said opening resting on said flanges bounding said openings, said web being formed with centering projection means substantially adjacent to said flanges operable to engage the edges of panels supported by said flanges and center such panels in said openings, said projection means being separated from the remaining material of said web by a lance cut having a portion extending in the direction of said flanges and another portion inclined relative to the direction of said flanges, said projection means providing a camming surface providing a substantial area inclined away from the adjacent portion of said web in the direction of the associated flange and a planar portion having a substantial area parallel to said web and laterally spaced therefrom, said camming surface operating to engage the edge of said panels and cam said edges away from said web as said panels move toward said flanges, and said planar portion operating to engage the edges of panels resting on said flanges with substantial area of contact to maintain said panel centered in said openings.

15. Panel centering grid tees as set forth in claim 14, wherein said projection means provide similar and opposite camming surfaces and planar portions on each side of said web.

16. Panel centering grid tees as set forth in claim 15, wherein said projection means includes a plurality of separate projections spaced along said grid tees, each projection providing a camming surface and a planar portion on each side of said central plane.

17. Panel centering grid tees as set forth in claim 14, wherein said lance cut is generally U-shaped with the base of said U extending in the direction of said flanges and providing longitudinally spaced legs of said U extending substantially perpendicular to the direction of said flanges, said lance cut separating the metal of said projection from the metal of said web along both sides thereof, and said projection is twisted and bent to provide said camming surfaces and planar portions on both sides of said central plane without substantial stretching of the metal of said projection.

18. Panel centering grid tees as set forth in claim 14, wherein said face width is about 9/16 inch and said planar portions are spaced from said central plane by about $\frac{1}{8}$ inch.

19. A suspension ceiling comprising a grid formed of a plurality of grid tees interconnected to form rectangular panel openings, said grid tees being symmetrical about a central plane, said grids being sized to space said central planes on opposite sides of said openings with a predetermined modular spacing, panels in said openings sized to fit in said openings with a predetermined clearance with respect to said central planes on opposite sides thereof, said grid tees providing a web extending along the associated of said central planes and providing oppositely extending flanges extending from the lower edge of said web substantially perpendicular thereto, said flanges bounding said openings and supporting said panels therein, said webs of said grid tees being formed with centering projections substantially adjacent to said flanges operable to engage the edges of panels supported by said flanges and center such panels in said openings, said projections being separated from the remaining material of said web by a lance cut having a portion extending in the direction of said flanges and another portion inclined relative to the direction of said flanges, said projections being bent too shape without appyling any substantial tensile stress to said web, said projections providing a camming surface inclined away from the adjacent portion of said web in the direction of the associated flange and a planar portion having a substantial area parallel to said webs and laterally spaced therefrom said camming surfaces operating to engage the edges of said panels and cam said edges away from said web as said panels move toward said flanges, and said planar portions operating to engage the edges of said panels resting on said flanges with substantial area of contact to maintain said panels centered in said openings.

20. A suspension ceiling as set forth in claim 19, wherein said projections provide similar and opposite camming surfaces and planar portions on each side of said webs.

21. A suspension ceiling as set forth in claim 20, wherein each projection provides a camming surface and a planar portion on each side of said central plane.

22. A suspension ceiling as set forth in claim 19, wherein said lance cut is generally U-shaped with the base of said U extending in the direction of said flanges and providing legs longitudinally spaced along said web extending substantially perpendicular to the direction of said flanges and separating the metal of said projections along both sides thereof from the remainder of said web, said projections being twisted and bent to provide said camming surfaces and planar portions on both sides of said central plane without any substantial stretch of the metal of said projections.

* * * * *

UNITED STATES PATENT AND TRADEMARK OFFICE

CERTIFICATE OF CORRECTION

PATENT NO. : 4,679,375

DATED : July 14, 1987

INVENTOR(S) : Richard Shirey and Gale E. Sauer

It is certified that error appears in the above-identified patent and that said Letters Patent is hereby corrected as shown below:

On the face of the patent, (75) Inventor should read as
--Richard Shirey, Avon Lake, Ohio
Gale E. Sauer, Sinclairville, New York--.

Column 2, Line 1, delete "a" (first occurrence) and insert --an--.

Column 7, Line 43, delete "at" and insert --a--.

Column 10, Line 37, after "therefrom" insert --,--.

Signed and Sealed this

Third Day of November, 1987

*Attest:*

DONALD J. QUIGG

*Attesting Officer*

*Commissioner of Patents and Trademarks*